United States Patent [19]

Brännström

[11] Patent Number: 4,669,395

[45] Date of Patent: Jun. 2, 1987

[54] PFBC PLANT WITH A MONITORING DEVICE FOR DETECTING EROSION DAMAGE

[75] Inventor: Roine Brännström, Finspong, Sweden

[73] Assignee: Asea Stal Aktiebolag, Fingspong, Sweden

[21] Appl. No.: 917,135

[22] Filed: Oct. 9, 1986

[30] Foreign Application Priority Data

Oct. 23, 1985 [SE] Sweden ..... 8504996

[51] Int. Cl.[4] ..... F23J 3/00

[52] U.S. Cl. ..... 110/216; 110/263; 110/245

[58] Field of Search ..... 110/216, 245, 263, 343; 122/4 D; 431/7, 170; 406/173; 55/337

[56] References Cited

U.S. PATENT DOCUMENTS 3,897,739 8/1975 Goldbach ..... 110/245 X
4,237,800 12/1980 Kullendorff et al. ..... 110/216
4,617,877 10/1986 Gamble ..... 110/216

*Primary Examiner*—Edward G. Favors
*Attorney, Agent, or Firm*—Pollock, Vande Sande & Priddy

[57] ABSTRACT

A PFBC plant which includes a gas cleaner located inside an air-filled pressure vessel is provided with means to detect erosion damage in the gas cleaner. Portions of the wall of the gas cleaner which are exposed to erosion damage are surrounded by a space defined by a gas-tight mantle. The mantle has an opening which provides a connection between the defined space and the air in the pressure vessel. Adjacent the opening is a device for indicating when air flows through the opening into the defined space.

8 Claims, 2 Drawing Figures

PFBC PLANT WITH A MONITORING DEVICE FOR DETECTING EROSION DAMAGE

TECHNICAL FIELD

The present invention relates to a combustion plant in which fuel is burnt in a pressurized fluidized bed, a so-called PFBC plant.

BACKGROUND ART

In a PFBC plant, normally a combustion chamber, containing the fluidized bed where fuel is burnt to generate combustion gases, and a cleaning plant, comprising a number of parallel groups of series-connected cyclones for the cleaning of the combustion gases, are placed within a common pressure vessel containing compressed combustion air. The flow resistance to gas passing through the combustion chamber and the cyclones gives rise to a fall in pressure so that the pressure existing in the cyclones is lower than that existing in the surrounding pressure vessel.

In the lowermost conical part of each cyclone and in the upper part of an outlet tube for solid separated material connected to the conical part, the gas mass and the solid material rotate at high velocity, which may lead to holes wearing in the conical wall or the tube wall. In the case of a hole in either wall, air from the surrounding space, where the pressure is higher than in the cyclone, will flow into the cyclone. This leads to a loss of combustion air, as well as a cooling of the combustion gases which are being used to drive a turbine. This means an energy loss. The air flowing in through such an erosion hole will also cause ignition of any unburnt fuel included in the separated material. Particularly in the case where the fuel is coal with a low ash content, the content of unburnt fuel in the separated material may be high and an intense combustion may result at the erosion hole. This combustion may lead to the initial size of the hole rapidly becoming greater or to a melt down of a substantial part of the outlet tube or the lowermost part of the cyclone.

The invention relates to a modified design of cyclone in which erosion damage in the lower part of the cyclone or in a tube used for discharge of cyclone-separated material can be indicated. The invention also relates to PFBC plant which can be safely operated for a considerable period of time after detectable erosion damage has occurred.

SUMMARY OF THE INVENTION

According to the invention, that part of the wall of the gas cleaning plant where the risk of erosion damage is greatest, is surrounded by a gas-tight mantle so as to define a space between the mantle and the wall of the gas cleaning plant located inside the mantle. The defined space thus formed communicates, through an opening of small cross-sectional size with the combustion air filling the pressure vessel. In the event of a hole appearing in the wall delimiting the defined space, air will flow into the gas cleaning plant and thus air will also flow through the opening in the mantle. Because the opening in the mantle has a small crosssectional area, the air flow rate is limited to a constant and low value even if the hole is enlarged by further erosion damage.

In the vicinity of the opening in the mantle an air flow indicating means is provided which senses air flow through the opening. In principle, a wide variety of different types of indicating devices can be used, but owing to the high ambient temperature likely to exist in the pressure vessel of a PFBC (of the order of magnitude of 300° C.) providing equipment to sense a temperature change is a most convenient air flow indicating means. One thermocouple can suitably be located so as to be contacted by any air flowing through the opening in the mantle, and another thermocouple can be located in contact with the wall of the gas cleaning plant, suitably on the lower conical part of a cyclone. The temperature difference between the two measuring points is determined under normal operating conditions with an undamaged cyclone. The temperature of the combustion air around the cyclones is lower than at the measuring points mentioned. In the event of cyclone leakage, air flows in through the opening in the mantle and past the said one thermocouple causing the sensed temperature difference between the two measuring points to change. By connecting the thermocouples to a signal processing device which compares the normal desired value of the temperature difference between the points and the actual temperature difference measured, a warning signal can be generated (e.g. to ignite a warning lamp on a control panel) when a leak occurs in the wall of the cleaning plant. The condition of the plant can be thus continuously monitored and any damaged cyclone can be repaired during a subsequent shutdown of the plant.

BRIEF DESCRIPTION OF THE DRAWINGS

The invention will be described in greater detail with reference to the accompanying drawings, wherein FIG. 1 schematically shows a PFBC power plant in which the invention is applied.

DESCRIPTION OF THE PREFERRED EMBODIMENT

Figure 1:
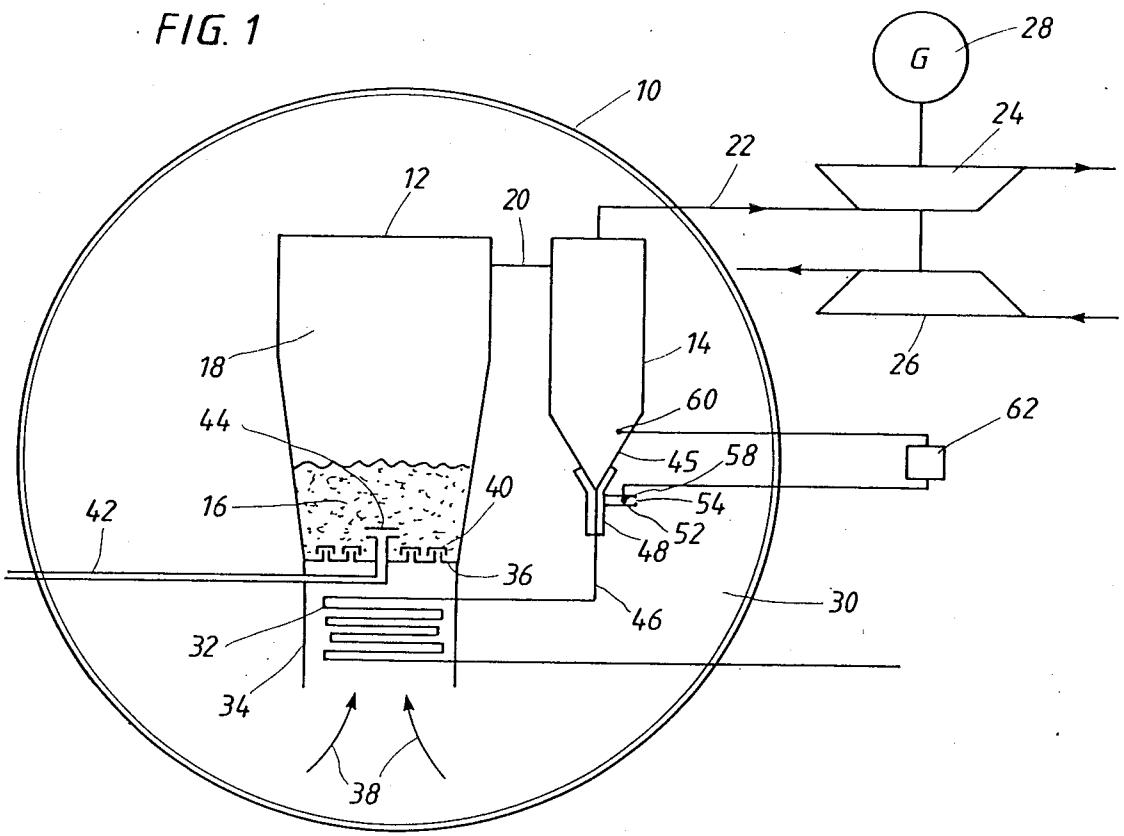
Figure 2:
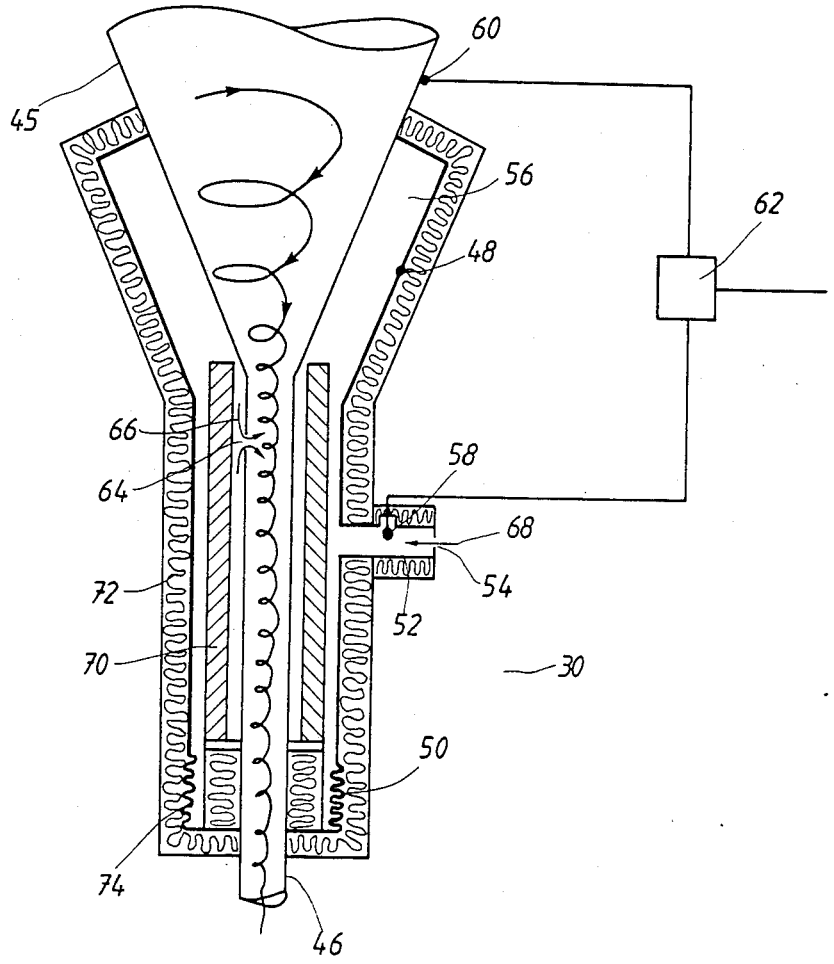
FIG. 2 shows a section through the lower part of cyclone, included in the plant of FIG. 1, where ashes and dust are separated from the flue gases leaving the combustion chamber before they are passed to a gas turbine.

In FIG. 1, 10 designates a pressure vessel in which is located a combustion chamber 12 and a cleaning plant, consisting of a number of cyclones 14. Only one cyclone 14 is shown in FIG. 1 but in reality the cleaning plant would comprise a number of parallel groups of series-connected cyclones 14. Combustion gases from a fluidized bed 16 are collected in a volume 18 and are led through a conduit 20 to the cyclones 14, in which dust and ashes are separated. The cleaned gases are then led through a conduit 22 to a turbine 24 which drives a compressor 26 and a generator 28. The compressor 26 supplies the space 30 in the pressure vessel 10 with combustion air.

Solid material separated in each cyclone 14 is transported away via an ash discharge device 32 which is cooled by the combustion air in a conduit 34 below a bottom wall 36 of the combustion chamber 12. The ash discharge device 32 may be designed in the manner disclosed in greater detail in the specification of European Patent Application No. 108 505. Combustion air flows from the space 30 up into the conduit 34, as shown by the arrows 38, and through nozzles 40 in the bottom wall 36. The air fluidizes the bed 16 and allows the supplied fuel to burn. Fuel is supplied to the bed 16 through a conduit 42 to a nozzle 44 from a fuel system (not shown). In reality, a plurality of fuel nozzles 44 would be provided, for example one nozzle per $m^2$ of area of the bottom wall 36.

At the outlet for separated material provided in the cyclone 14, the conical part 45 of the cyclone and the outlet tube 46 therefor are surrounded by a gastight mantle 48 which, in view of the different temperatures and thermal expansions of the mantle 48 and the part 44 and the tube 46, is formed as a bellows 50 in its lower part. A tubular sleeve, which terminates in an opening 54 of small cross-section, is connected to the mantle 48. Through the opening 54 the space 56 defined between the mantle 48, the part 45 and the tube 46 communicates with the combustion air in the space 30. In the tubular sleeve 52 a thermocouple 58 is located and this senses the temperature $T_1$ at this point. A second thermocouple 60 is positioned on the part 44 and senses the temperature $T_2$ thereof. These thermocouples 58 and 60 are connected to a signal processing means 62, which compares the actual emf difference with the desired emf difference and indicates the appearance of any impermissible difference. During normal operation, a difference $\Delta T$ between temperatures $T_1$ and $T_2$ measured by the thermocouples 58 and 60 gives rise to a certain, empirically calculated desired emf difference value. In the event of erosion causing a hole 64 to appear in the lower part 45 of the cyclone or in the upper part of the tube 46, combustion air (at a temperature of $T_0$) flows from the space 56 into the cyclone 14 through the opening 64, as shown by the arrows 66, because of the fact that a higher pressure exists in the space 30 than exists in the cyclone 14. To compensate for the loss of air from the space 56 combustion air flows from the space 30 into the space 56 through the opening 54 in the tubular sleeve 52, as shown by the arrow 68. The opening 54 is dimensioned to provide such a restricted passage that only a slight flow of air passes through it in the event of even severe erosion damage. The temperature $T_0$ in the space 30 is, during normal operation, considerably lower than the temperature of the air in the tubular sleeve 52. Thus, in the event of an air leak caused by erosion damage, the air flowing into the tubular sleeve 52 will cool the thermocouple 58, thus providing an abnormal temperature difference between the two measuring points monitored by the means 62. The signal processing means 62 will therefore indicate a change from the normal value and an alarm signal will be triggered. Because the air flow into the space 56 is limited by the throttled opening 54, the plant can be operated without any risk for a considerable period of time after first indication of erosion damage before the damaged area needs to be repaired.

It may be convenient to locate a sleeve 70 of a wear-resistant material, for example of a ceramic material, in the space 56. In the event of erosion damage, this sleeve 70 protects the mantle 48. The mantle 48 can then be made of thin material of relatively low cost (e.g. steel sheet of a standard quality). The mantle 48 and the tubular sleeve 52 may be surrounded by a thermally insulating layer 72. Thermal insulation between the bellows 50 and the tube 46 below the sleeve 70 reduces the temperature of the bellows 50 so that a cheaper material can be used for manufacturing the bellows 50.

In the embodiment illustrated, two thermocouples have been used for indicating the presence of air flow between the spaces 30 and 56. Thermocouples have been chosen because of the high ambient temperature, about 300° C. However, other indicating devices which withstand this high ambient temperature may, of course, be employed. Other modifications can also be made to the plant illustrated within the spirit and scope of the following claims. Thus, although of particular utility in protecting the cyclones of a gas cleaning plant from the consequences of erosion damage, the principle of the invention can be applied to any other wall region subject to an erosion risk and maintaining a pressure difference across them.

What is claimed is:

1. A PFBC plant comprising a combustion chamber, a cleaning plant for the separation of dust from combustion gases leaving the combustion chamber, a pressure vessel surrounding the said chamber and cleaning plant and containing compressed air, characterized in that a portion of a wall of the cleaning plant exposed to the risk of erosion damage is surrounded by a gas-tight mantle which, together with the said wall, forms a defined space, in that the mantle has an opening communicating with the compressed air in the pressure vessel and in that means for indicating air flow through said opening is located adjacent said opening.

2. A plant according to claim 1, in which the mantle surrounds the lowermost part of a cyclone and the adjacent part of an outlet tube from the cyclone.

3. A plant according to claim 2, in which a first temperature sensing device is located adjacent the opening in the mantle so that said first device is contacted by air flowing through said opening, and a second temperature sensing device is located adjacent to a wall of the cyclone for indicating the temperature of the cyclone wall.

4. A plant according to claim 3, in which the temperature sensing devices are connected to a signal processing device which compares a desired value of the difference between the temperatures at the measuring points with the currently existing temperature difference between the measuring points.

5. A plant according to claim 4, in which each temperature sensing device is a thermocouple.

6. A plant according to claim 2, in which between the gas-tight mantle and the cyclone a sleeve of an erosion-resistant material is located.

7. A plant according to claim 2, in which between the gas-tight mantle and the tube a sleeve of an erosion-resistant material is located.

8. In a PFBC plant the provision of a protective means for a wall subject to erosion during use of the plant and which has a pressure difference across it during use of the plant, which protective means includes a mantle creating a defined space delimited by said wall, a restricted gas inlet to said defined space and means to indicate when there is an abnormal flow of gas through the inlet.

* * * * *